US005115273A

United States Patent [19]

Ujiie et al.

[11] Patent Number: 5,115,273

[45] Date of Patent: May 19, 1992

[54] IMAGE FORMING APPARATUS HAVING A DETACHABLE MEMORY

[75] Inventors: Souhei Ujiie; Tadashi Suzuki, both of Yokohama, Japan

[73] Assignee: Canon Kabushiki Kaisha, Tokyo, Japan

[21] Appl. No.: 525,708

[22] Filed: May 21, 1990

[30] Foreign Application Priority Data

May 26, 1989 [JP] Japan ..... 1-131295

[51] Int. Cl.[5] ..... G03G 21/00

[52] U.S. Cl. ..... 355/209; 355/202; 355/314

[58] Field of Search ..... 355/209, 202, 314, 200, 355/204, 319

[56] References Cited

U.S. PATENT DOCUMENTS 4,310,235 1/1982 Lorenzo et al. ..... 355/314
4,711,560 12/1987 Hosaka et al. ..... 355/200
4,937,624 6/1990 Kohtani et al. .
4,937,626 6/1990 Kohtani et al. .

FOREIGN PATENT DOCUMENTS 0252613 1/1988 European Pat. Off. .
0301459 2/1989 European Pat. Off. .
2560416 7/1975 Fed. Rep. of Germany .
0052867 3/1985 Japan .
0263166 12/1985 Japan .
63-204266 8/1988 Japan .
2211971 7/1989 United Kingdom .

*Primary Examiner*—A. T. Grimley
*Assistant Examiner*—Thu Dang
*Attorney, Agent, or Firm*—Fitzpatrick, Cella, Harper & Scinto

[57] ABSTRACT

An image forming apparatus from which an external memory medium storing an image formation mode operable in various kinds of image forming apparatus and being adapted for use in various kinds of image forming apparatus on a common basis is detachable. The apparatus includes an image forming unit for forming an image on a recording material in a desired image formation mode, an attachment unit adapted to attach the external memory medium thereto, a discriminator for discriminating as to whether an image formation mode stored in the external memory medium is executable or not when the external memory medium is attached to the image forming apparatus and an information unit for informing a discrimination result by the discriminator.

16 Claims, 9 Drawing Sheets

FIG.8A

SELECTION OF REG./
CALLING OF COPY MODE

REG. OF COPY MODE
▶CALLING OF COPY MODE

FIG.8B

SELECTION OF COPY MODE

MODE 1 MODE 4
MODE 2 ▶ MODE 5
MODE 3

OK *

FIG.8C

IS OTHER COPY MODE
SELECTED ?

YES NO

FIG.8D

COPY MODE 3 HAS
BEEN SELECTED

FIG.8E

COPY MODE 5 IS NOT
AVAILABLE IN THIS
MACHINE

FIG.8F

COPY INHIBITION
RELEASE IT BY
RESET KEY

FIG.8G

BOTH-SIDE COPY IS
NOT AVAILABLE IN
THIS MACHINE

FIG.8H

SELECTION OF COPY MODE
TO BE REGISTERED

MODE 1 MODE 4
MODE 2 ▶ MODE 5
MODE 3

OK *

FIG.8I

IT HAS BEEN
REGISTERED AS
COPY MODE 2

IMAGE FORMING APPARATUS HAVING A DETACHABLE MEMORY

BACKGROUND OF THE INVENTION

1. Field of the Invention

The present invention relates to an image forming apparatus for reading and automatically setting an image formation mode stored in an external memory means such as an IC card.

2. Related Background Art

In recent office processing, various types of copy processing are required. In order to satisfy these requirements of users, therefore, the intelligence of copy functions has been rapidly improved, and keys for setting various types of functions such as two-side copying, multi transfer, trimming, stamp copying, and add-on copying and indicators therefor are normally arranged on an operation unit.

Some users, however, may perform only simple copying such as one-side equal-magnification copying. In addition, if a user usually executes copy work in a complicated mode, but the same copy mode, he or she must perform a complicated copy mode setting operation upon each copying and therefore this easily causes a setting error. Furthermore, since considerably time is required before a desired image is output, image formation cannot be performed with high efficiency.

In order to eliminate the above drawbacks, therefore, a copying apparatus in which a copy mode having a high use frequency can be registered in a back-up memory medium and automatically set by a simple operation using, e.g., a key is proposed.

In an apparatus of this type, however, the number of copy modes capable of being registered is limited. Therefore, this apparatus cannot satisfactorily achieve its effect in an office or the like with a large number of users.

In addition, an apparatus in which a copy mode used by a specific user is stored in external memory means such as an IC card and automatically set upon copy mode setting is proposed (U.S. Ser. No. 298334 filed on Jan. 17, 1989). The external memory means of an apparatus of this type, however, can be used in only a one-to-one operational environment with respect to a specific copying apparatus. Therefore, a copy mode stored in this external memory means cannot be read out by an apparatus of another type, resulting in very low versatility.

SUMMARY OF THE INVENTION

The present invention has been made in consideration of the above situation, and has as its object to provide an improved image forming apparatus.

It is another object of the present invention to allow an external memory means storing an image formation mode to be used between arbitrary types of machines.

It is still another object of the present invention to improve operability of an image forming apparatus capable of setting an image formation mode by using an external memory means storing an image formation mode.

It is still another object of the present invention to provide an image forming apparatus capable of selecting a realizable image formation mode from a plurality of image formation modes stored in an external memory means.

It is still another object of the present invention to provide an image forming apparatus capable of determining and setting a realizable parameter from a selected image formation mode.

It is still another object of the present invention to provide an image forming apparatus capable of selecting the last accessed copy mode prior to others from a plurality of copy modes stored in external memory means.

BRIEF DESCRIPTION OF THE DRAWINGS

FIGS. 8A to 8I are views showing display transition for explaining a message display state on a display shown in FIG. 3.

DETAILED DESCRIPTION OF THE PREFERRED EMBODIMENTS

An embodiment of the present invention will be described in detail below with reference to the accompanying drawings.

Figure 1A:
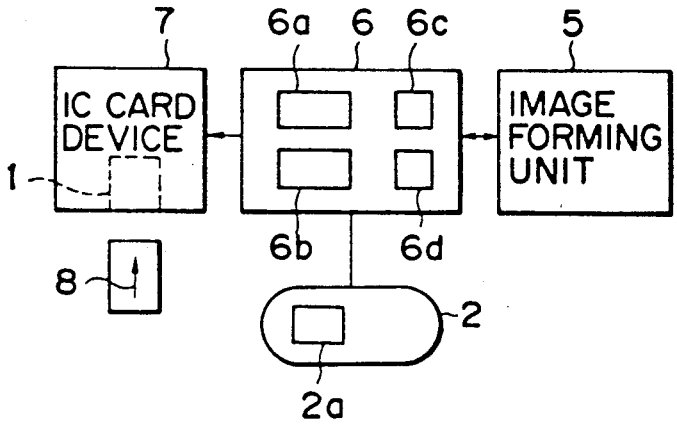
FIG. 1A is a block diagram for explaining an arrangement of an image forming apparatus according to an embodiment of the present invention.

FIG. 1A is a block diagram for explaining an arrangement of an image forming apparatus according to an embodiment of the present invention. Referring to FIG. 1A, an IC card 8 (external mode memory means) is inserted in an insertion port 1. An IC card device 7 which also serves as a detecting means monitors insertion of the IC card 8 in the insertion port 1 and outputs an insertion detection signal to a controller unit 6. The controller unit 6 systematically controls the respective units in accordance with control programs (including sequences of flow charts to be described later) stored in ROM 6*d*.

An image forming unit 5 is constituted of a photosensitive drum, a developer, a transfer charger, a fixer, a paper conveying mechanism, and the like (none of which are shown).

A determining means 6a determines realizability of each copy mode stored in the IC card 8 in accordance with an output from the IC card device 7 and sends the determination result to an alarming means 6b and a selective setting means 6c. The alarming means 6b causes a display of an operation unit 2 to display information in accordance with the determination result. The selective setting means 6c selects and automatically sets a realizable one of a plurality of copy modes from the IC card 8 so that the selected mode can be set later prior to others (as will be described in detail later).

A copy mode set by an arbitrary type of machine is written in the IC card 8 constituting an external mode memory means on the basis of a common data format. The IC card 8 can be inserted in the insertion port 1 of an arbitrary type of machine.

When the IC card device 7 detects insertion of the IC card 8, the determining means 6a determines realizability of a stored operation mode, and the alarming means 6b sends the determination result to the display 2a. If the operation mode is realizable, the selective setting means 6c selects and automatically sets one copy mode stored in the external mode memory means, thereby enabling the use of an arbitrary copy mode set by an apparatus of another type.

In accordance with the determination result from the determining means 6a, the selective setting means 6c selectively sets, as a first candidate, one copy mode which was last accessed from the IC card 8 by the selective setting means 6c and automatically sets one copy mode in correspondence with its setting history.

Immediately after the IC card device detects insertion of the IC card 8, the selective setting means 6c sets a write/read mode selection state with respect to the IC card 8 as an operation mode, thereby easily switching access to the IC card 8.

In addition, immediately after the IC card device 7 detects insertion of the IC card 8, the selective setting means 6c sets a read mode with respect to the IC card 8 as an operation mode prior to other modes, thereby rapidly setting a copy mode stored in the IC card 8.

Figure 1B:
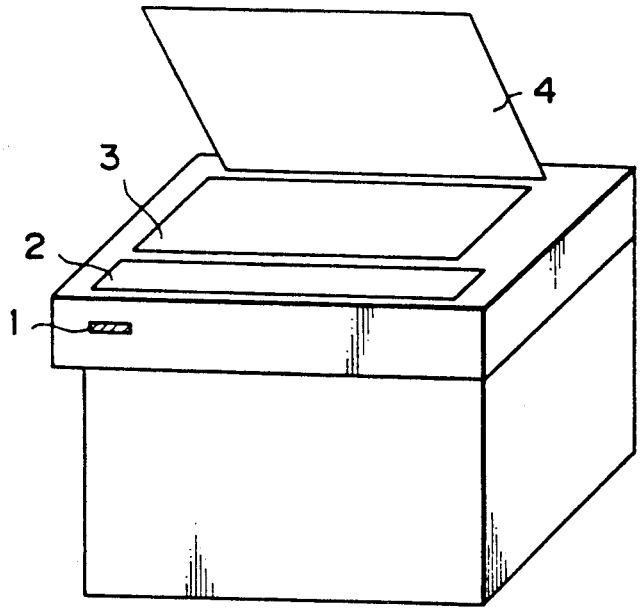
FIG. 1B is a perspective view for explaining the outer appearance of the image forming apparatus shown in FIG. 1A.

FIG. 1B is a perspective view for explaining the outer appearance of the image forming apparatus shown in FIG. 1A, in which the same reference numerals as in FIG. 1A denote the same parts.

Referring to FIG. 1B, original table glass 3 is placed in a reference position and pressed by an original pressing plate 4.

Setting of a copy mode of an image forming apparatus of another type will be described below with reference to FIGS. 2A, 2B, and 3.

Figure 2A:
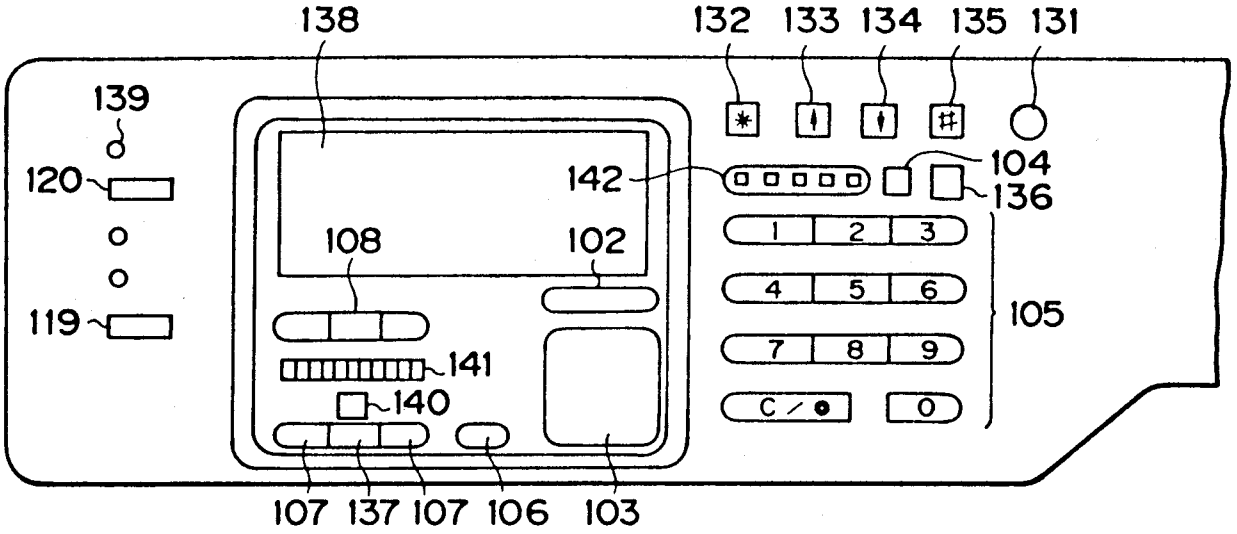
FIGS. 2A and 2B are plan views for explaining a main part of a first arrangement of an operation unit shown in FIG. 1.
Figure 2B:
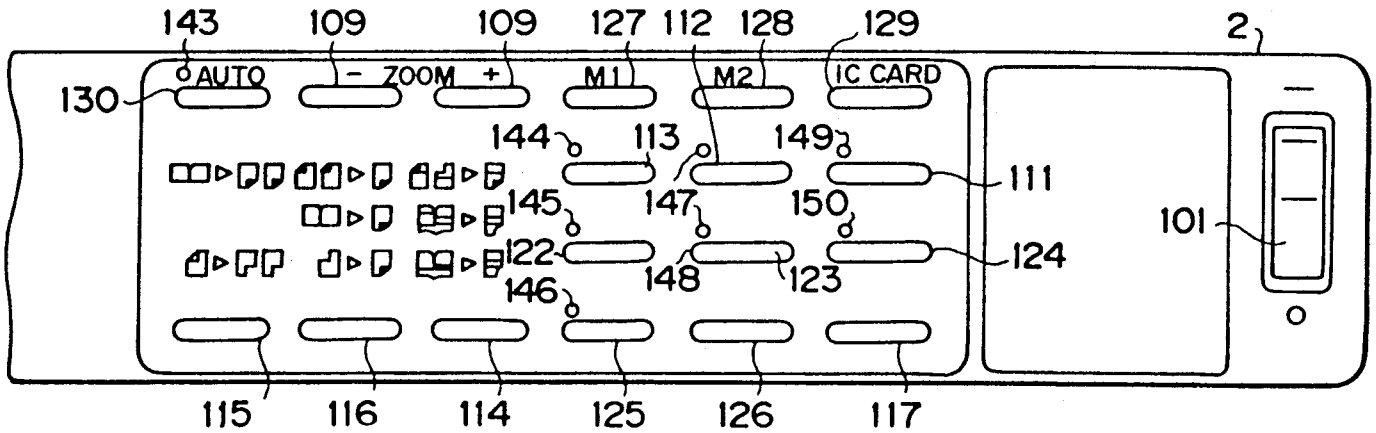

FIGS. 2A and 2B are plan views for explaining a main part of a first arrangement of the operation unit 2 shown in FIG. 1, in which a first operation unit is illustrated as two parts separated by a curve.

Referring to FIGS. 2A and 2B, a power switch 101 controls power supply to a copying machine (image forming apparatus). A reset key 102 operates as a key for restoring a standard mode in a stand-by state. This operation unit also includes a copy key 103 and a color developer selective switching key for selectively switching a plurality of developers (not shown).

Ten keys 105 are used to input mainly the number of copies. A cassette selection key 106 is used to designate the destination of paper supplied from a paper supply mechanism such as a pedestal (not shown). A copy density adjusting key 107 is used to adjust a copy density, and an equal-magnification key 108 is depressed to select equal-magnification copy. A zoom key 109 is used to designate a copy magnification in units of predetermined magnifications, e.g., 1%.

A regular magnification key 110 is depressed to designate a regular reduction or enlargement magnification. A frame erasing key 111 is depressed to erase a frame of a copied sheet. A gutter key 112 is depressed to form a gutter at one end of a copied sheet. A photograph mode key 113 is depressed to copy a half-tone image such as a photographic original.

An area designation key 125 is depressed to perform area designation. An area call key 126 is depressed to partially correct the contents of an area set by the area designation key 125. A guide key 117 is depressed to check the contents of each function. A preheating mode key 131 is used to set a preheating mode.

A multi key 114 is depressed to select a multi mode. A continuous copy key 115 is depressed to divide a copy area of the original table glass 3 into two, right and left parts (division areas change in accordance with the size of a copy sheet), thereby automatically, continuously copying images on two sheets. A two-side key 116 is depressed to select a two-side copy mode. Sorter keys 119 and 120 are depressed to designate an operation mode (grouping, sorting, or the like) of a sorter. Character keys 122 to 124 are depressed to form date information (having a plurality of types of data recording schemes) which is updated and stored beforehand on a copy sheet. The character key 123 is depressed to form memorandum information input by depressing character keys provided on a digitizer (not shown) on a copy sheet. The character key 124 is depressed to form numbering information on a copy sheet. Mode memory keys 127 and 128 are depressed to store a copy mode set by the operation unit 2 in a main body memory (a (back-up) RAM of the controller unit 6). An IC card key 129 is depressed to store a copy mode set by the operation unit 2 in the IC card 8 shown in FIG. 1A.

An auto magnification change key 130 is depressed to automatically enlarge or reduce an original image in accordance with the size of a transfer sheet.

An up key 133 and a down key 134 are depressed to move a designation guide (in this embodiment, a triangular mark) displayed on a screen of a display 138, thereby designating an element to be selected. The display 138 is constituted by a liquid crystal display device with a back light and displays the number of copies, a transfer sheet size, a set magnification, a message, and the like. After an asterisk key 132 is depressed, the ten keys 105 are depressed to set various types of modes. The operation unit also includes a registration key 135 and a password key 136.

Indicators 139 to 150 are constituted by light-emitting diodes (LEDs). When a sorter is to be used, the indicator 139 is turned on to indicate a sort mode, a group mode, or the like. The indicator 140 is turned on when an automatic exposure adjustment (AE) key 137 is depressed, and the indicator 141 indicates a density level corresponding to a density set by the density key. When a color developer is selected from a plurality of developers stored in a developer storage unit which is arranged in a main body of the apparatus or optionally provided, a light having a color corresponding to the color of the selected developer is emitted by in the indicator 142. The indicator 143 is turned on when the auto magnification change key 130 is depressed. The indicator 144 is turned on when a photograph mode is set. The indicator 145 is turned on when a date write mode is set. The indicator 146 is turned on when area designation is set. The indicator 147 is turned on when a gutter mode is set. The indicator 148 is turned on when a memo write mode is set. The indicator 149 is turned on when a frame erase mode is set. The indicator 150 is turned on when a number write mode is set.

Figure 3:
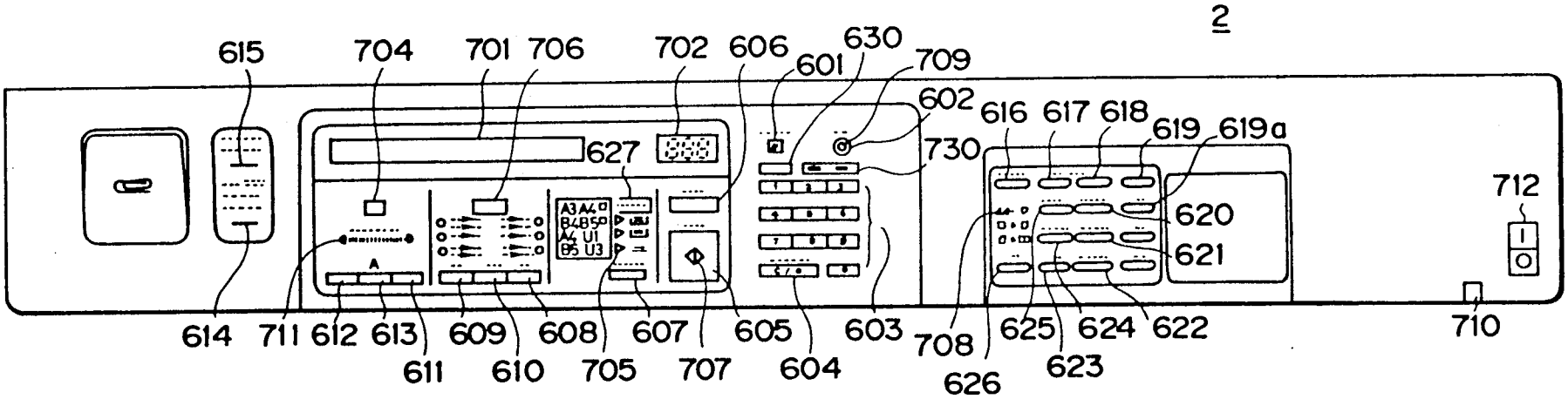
FIG. 3 is a plan view for explaining a main part of a second arrangement of the operation unit shown in FIG. 1.

FIG. 3 is a plan view showing a main part for explaining a second arrangement of the operation unit 2.

Referring to FIG. 3, an asterisk key (* key) is used by an operator (user) in a mode for setting a gutter or a size of an original frame erasure. An all reset key 606 is depressed to restore a standard mode. A preheating key 602 is depressed to set the main body in a preheating state or release the preheating state. The preheating key is also depressed in order to restore the standard mode from an auto shut-off state.

A copy start key 605 is depressed to start copying. A clear/stop key 604 functions as a clear key in a stand-by state and as a stop key during copy recording. The clear/stop key 604 is depressed to release a set number of copies and to release an asterisk mode. When the clear/stop key 604 is depressed to interrupt continuous copying, a copy operation is stopped after copying which is executed when depression is finished.

Ten keys 603 are depressed to set the number of copies. The ten keys 603 are also used to set the asterisk mode. A memory key 619 is depressed to register a mode which is frequently used by a user in a main body memory. The memory key 619 is substantially the same as the mode memory keys 127 and 128 shown in FIG. 2B.

An IC card key 619*a* is depressed to store a copy mode which is frequently used by a user in the IC card 8.

Copy density keys 611 and 612 are depressed to manually adjust a copy density. When the IC card key 619*a* is depressed, the copy density keys 611 and 612 also function as keys for moving a mark serving as a designation guide on a display 701 until mode setting is finished. An AE key 613 is depressed to automatically adjust a copy density in accordance with the density of an original or to release AE (automatic copy density adjustment) to set manual density adjustment. A cassette selection key 607 id depressed to select one of an upper cassette, a middle cassette, and a lower paper deck. An auto paper cassette selection key 627 is used to automatically select a cassette corresponding to an original and a designated magnification.

An equal magnification key 610 is depressed to obtain a copy in an equal magnification (original size). An auto magnification change key 616 is depressed to automatically enlarge or reduce an original image in accordance with the side of a designated transfer sheet. Zoom keys 617 and 618 are depressed to designate an arbitrary magnification from 50% to 200%.

Regular magnification change keys 608 and 609 are depressed to designate reduction or enlargement of a regular size.

A two-side key 626 is depressed to perform two-side copying from a one-side original or two-side or one-side copying from a two-side original. A gutter key 625 is used to form a gutter having a designated length at a left side of a transfer sheet. A photograph key 624 is depressed to copy a photographic original. A multi key 623 is depressed to form (synthesize) an image on one surface of a transfer sheet from two originals.

An original frame erase key 620 is depressed to erase a frame of a regular size original. Upon frame erasure, the size of an original is set by the asterisk key 601. A sheet frame erase key 621 is depressed to erase a frame of an original in accordance with the size of a cassette.

A page continuous copy key 622 is depressed to copy right and left pages of an original on different sheets.

A paper discharge method (stapling, sorting, and grouping) selection key 614 is used to select or release a staple mode or a sort mode when a stapler capable of binding recorded sheets by staple is connected, and to select or release a sort mode or a group mode when a sorting tray (sorter) is connected.

A paper folding selection key 615 is used to select or release Z folding for folding A3- or B4-size recorded paper into a Z sectional shape or half folding for folding A3- or B4-size paper in half.

Each time a selection key 630 is depressed, a black developer and a color developer are alternately selected.

A display 701 is of an LCD (liquid crystal display) type for forming one character by, e.g., 5×7 dots. The display 701 can display a message of 40 characters and a copy magnification set by the regular magnification change keys 608 and 609, the equal magnification key 610, and the zoom keys 617 and 618. The display 701 consists of a semi-transmission liquid crystal and uses back lights of two colors. A green back light is turned on in a normal operation, and an orange back light is turned on in an abnormal or copy disable state.

An equal magnification indicator 706 is turned when an equal magnification is selected. A developer indicator 730 indicates a selected developer. A copy number indicator 702 indicates a copy number or a self-diagnosis code. A cassette indicator 705 indicates a selected one of an upper cassette, a middle cassette, and a lower deck.

An AE indicator 704 is turned on when AE (automatic copy density adjustment) is selected by the AE key 613. A preheating indicator 709 is turned on in a preheating state. The preheating indicator 709 is turned on/off in an auto shut-off state. A ready/wait indicator 707 is constituted by two color LEDs of green and orange. A green light is turned on in a ready state (copy enable state), and an orange light is turned on in a wait state (copy disable state).

A two-side copy indicator 708 is turned on when two-side copying from a two-side original or a one-side original is selected.

When a standard mode RDF is used, copy conditions are a copy number of one, auto paper selection, an equal magnification, and one-side copying from a one-side original. In a standard mode not using an RDF, copy conditions are a copy number of one, a density manual mode, an equal magnification, and one-side copying from an one-side original.

A difference in conditions between the use and non-use of the standard mode RDF is determined on the basis of whether an original is set in the RDF.

A power lamp 710 is turned on when a power switch 712 is turned on. A copy density indicator 711 indicates a copy density.

A copy mode processing operation on the basis of the IC card 8 will be described below with reference to FIGS. 4A to 4C.

Figure 4A:
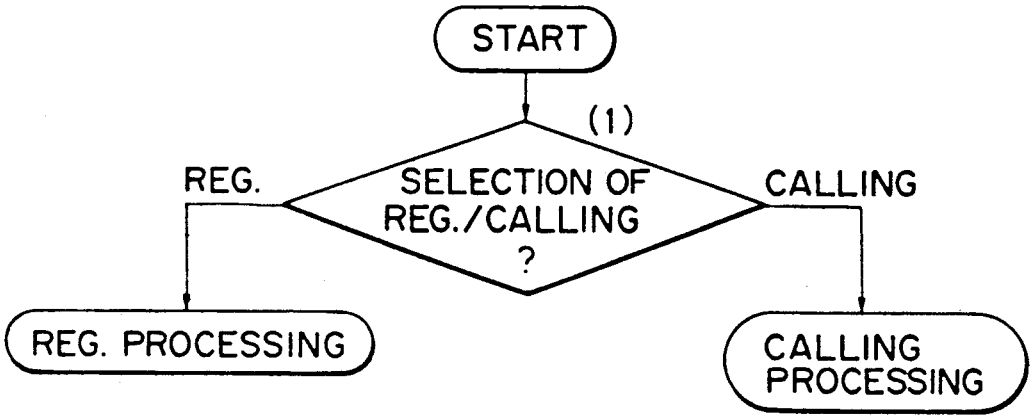
FIG. 4A is a flow chart for explaining a first copy mode selecting processing sequence according to the present invention.

FIG. 4A is a flow chart showing a first copy mode selecting processing sequence according to the present invention. Note that reference numeral (1) denotes a step.

When the IC card key 129 is depressed, registration/-calling processing for the copy mode recording device is started, and the display 138 displays a mode selection item, in this case, copy mode registration/calling (see FIG. 8A).

The controller unit 6 checks whether registration or calling is selected by the up and down keys 133 and 134 (1). If registration is selected, the flow advances to copy mode registering processing to be described later. If calling is selected, the flow advances to copy mode calling processing.

Figure 4B:
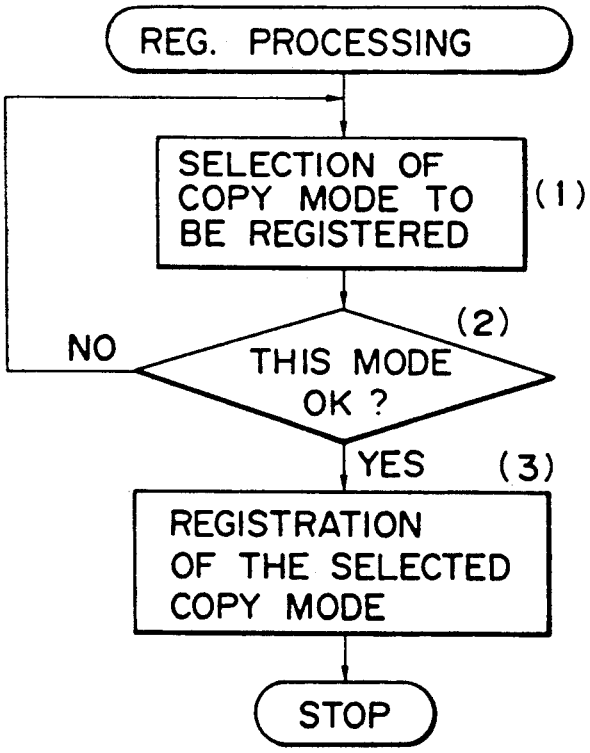
FIG. 4B is a flow chart for explaining a copy mode registering processing sequence according to the present invention.

FIG. 4B is a flow chart showing copy mode registering processing according to the present invention. Note that reference numerals (1) to (3) denote steps.

The controller unit 6 displays a copy mode number to be registered on the display 138 as shown in FIG. 8H (1) and selects the copy mode number to be registered on the basis of an input from the up and down keys 133 and 134.

The controller unit 6 checks in accordance with a depression state of the asterisk key 601 whether various parameters such as magnification and the number of copies currently set on the operation unit 2 are to be registered in the selected copy mode (2). If NO in step (2), the flow returns to step (1) to repeat the selecting processing. If YES in step (2), the controller unit 6 registers the parameters in the selected mode and displays the contents shown in FIG. 8I, thereby ending the processing.

Figure 4C:
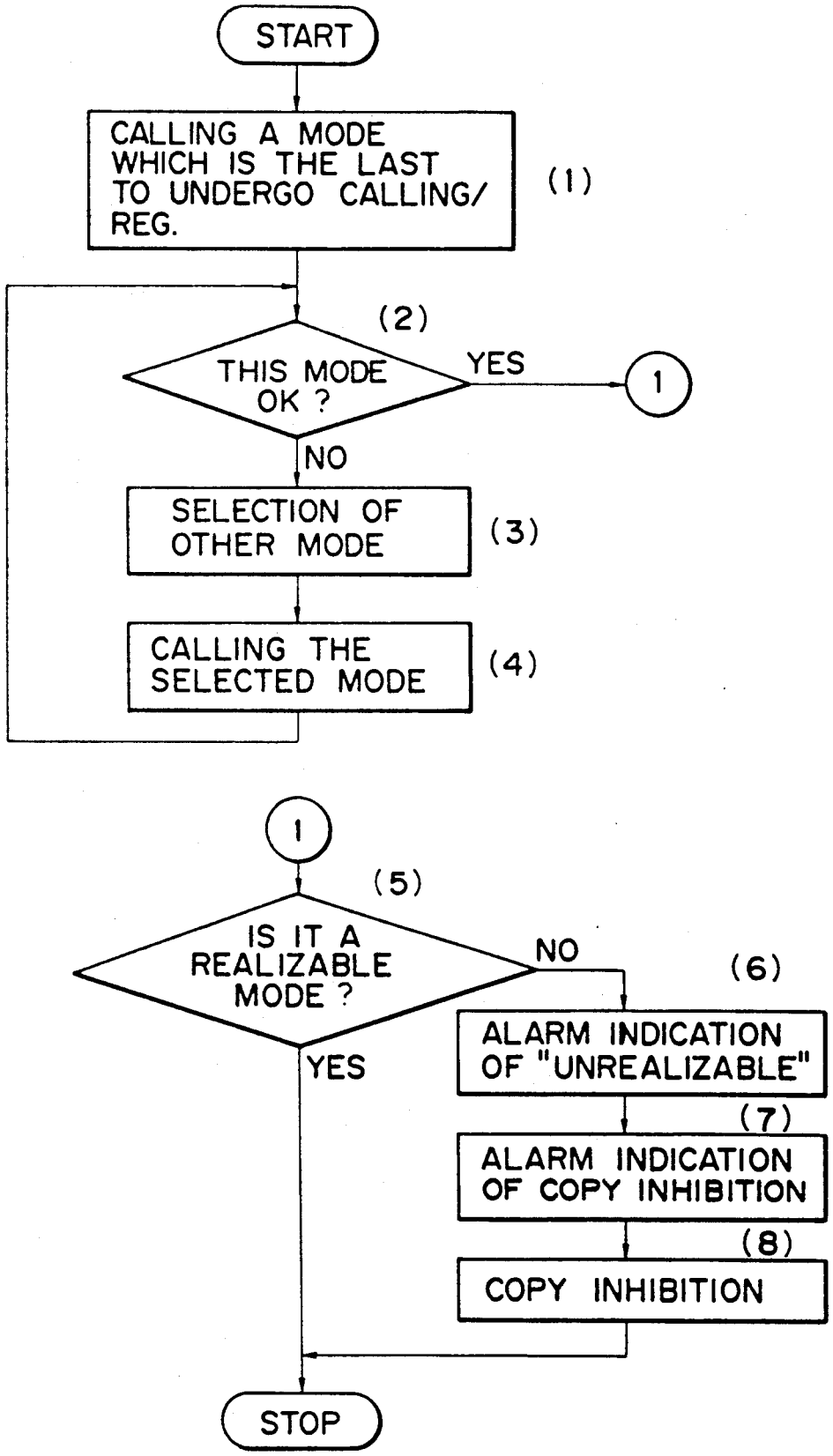
FIG. 4C is a flow chart for explaining a first copy mode calling processing sequence according to the present invention.

FIG. 4C is a flow chart for explaining a first copy mode calling processing sequence according to the present invention.

When the calling processing is started, the controller unit 6 calls a mode which is the last to undergo calling-/registration from registered copy modes (1) and displays the called mode on the display 138 as shown in FIG. 8B. The controller unit 6 checks in accordance with a depression state of the asterisk key 601 whether a copy mode designated by the designation guide is OK (2). If NO in step (2), another mode is selected by the up and down keys 133 and 134 (3), the selected copy mode is called from the IC card 8 (4), and the flow returns to step (2).

If YES in step (2), the controller unit 6 checks whether the called copy mode is a realizable mode of a copying machine in which the IC card 8 is inserted (5). If YES in step (5), the controller unit 6 ends the calling processing.

If NO in step (5), the controller 6 displays an alarm indication of "unrealizable" on the display 138 as shown in FIG. 8E (6).

The controller unit 6 displays an alarm indication of copy inhibition, i.e., a message shown in FIG. 8F on the display 138 (7), executes copy inhibition processing (8), and ends the processing.

Figure 5:
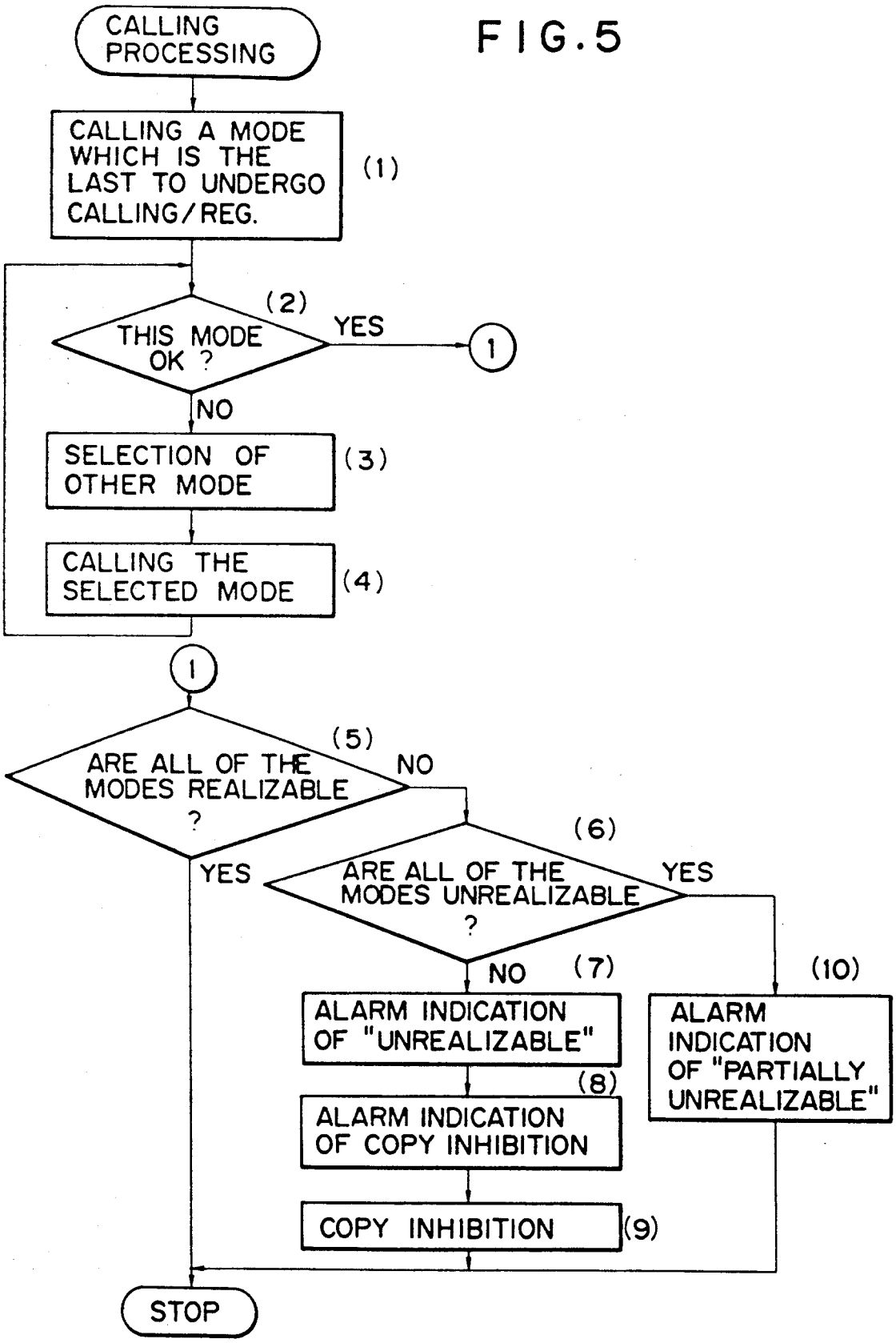
FIG. 5 is a flow chart for explaining a second copy mode calling processing sequence according to the present invention.

FIG. 5 is a flow chart for explaining a second copy mode calling processing sequence according to the present invention. Note that reference numerals (1) to (10) denote steps.

When the calling processing is started, the controller unit 6 calls a mode which is the last to undergo calling-/registration from registered copy modes (1) and displays the called mode on the display 138 as shown in FIG. 8B. The controller unit 6 checks in accordance with a depression state of the asterisk key 601 whether a copy mode designated by the designation guide is OK (2). If NO in step (2), the other mode is selected by the up and down keys 133 and 134 (3), the selected copy mode is called from the IC card 8 (4), and the flow returns to step (2).

If YES in step (2), the controller unit 6 checks whether the called copy mode is realizable. If YES in step (5), the controller unit 6 ends the calling processing.

If NO in step (5), the controller unit 6 checks whether all of the modes are unrealizable (6). If YES in step (6), the controller unit 6 causes the display 138 to display alarm indication of "unrealizable" as a message shown in FIG. 8E (7). The controller unit 6 then causes the display 138 to display alarm indication of copy inhibition as a message shown in FIG. 8F (8), executes copy inhibition processing (9), and ends the processing.

If NO in step (6), the controller unit 6 causes the display 138 to display alarm indication of "partially unrealizable" (10), and ends the processing.

For example, if two-side copying is included in a selected copy mode and a copying machine in which the IC card is inserted has no two-side copy function, a message as shown in FIG. 8G is displayed on the display 138.

Figure 6:
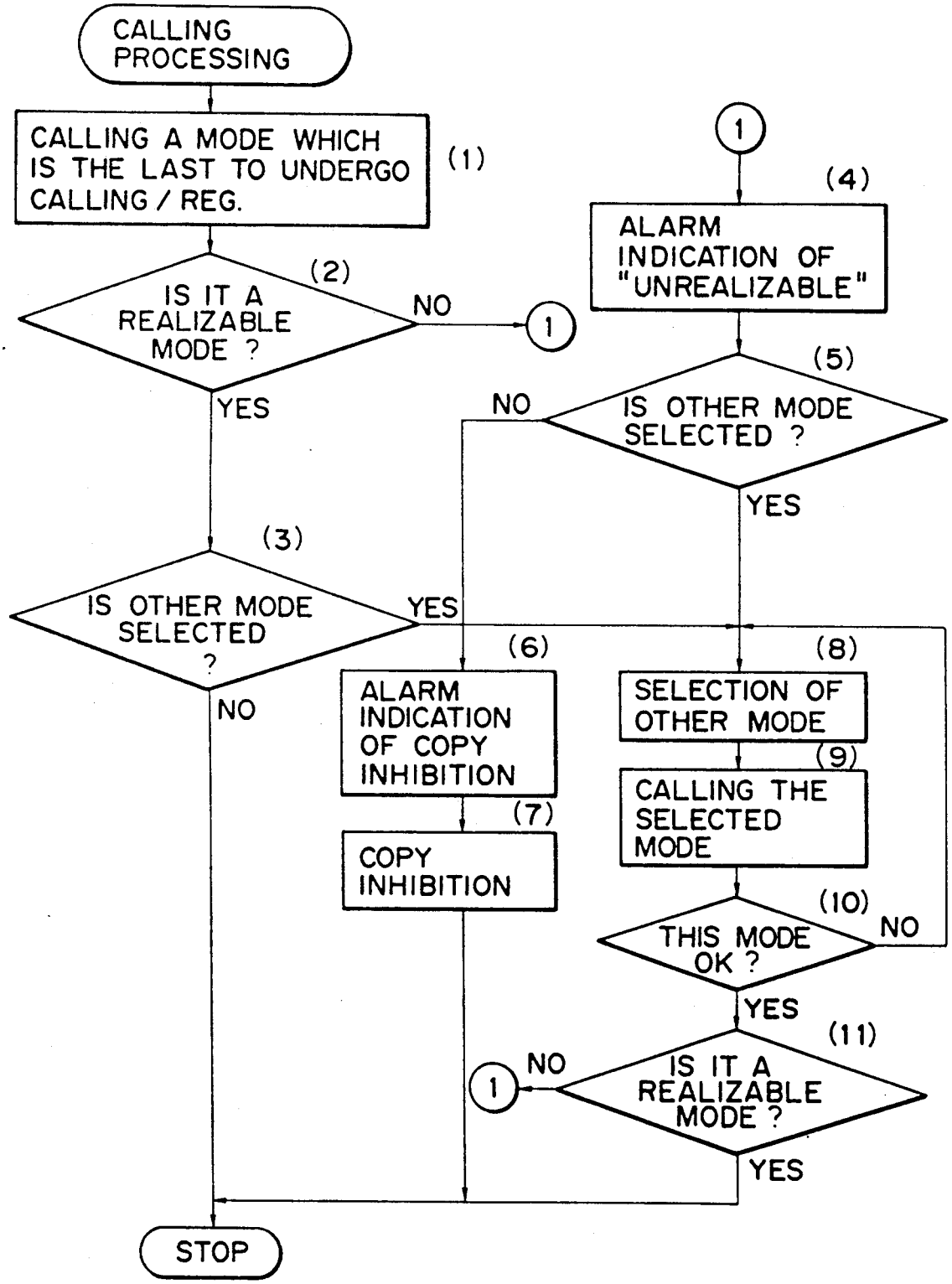
FIG. 6 is a flow chart for explaining a third copy mode calling processing sequence according to the present invention.

FIG. 6 is a flow chart for explaining a third copy mode calling processing sequence according to the present invention. Note that reference numerals (1) to (11) denote steps.

When the calling processing is started, the controller unit 6 calls a mode which is the last undergo calling-/registration from registered copy modes (1) and displays the called mode on the display 138 as shown in FIG. 8D.

The controller unit 6 checks whether the displayed copied mode is realizable (2). If YES in step (2), the controller unit 6 causes the display 138 to display a message shown in FIG. 8C and checks whether the other mode is to be selected by the up and down keys 133 and 134 (3). If NO in step (3), the controller unit 6 ends the calling processing. If YES in step (3), the flow advances to step (8) and subsequent steps.

If NO in step (2), the controller unit 6 causes the display 138 to display an alarm indication of "unrealizable" as a message shown in FIG. 8E (4). The controller unit 6 then causes the display 138 to display a message shown in FIG. 8C and checks whether the other mode is to be selected by the up and down keys 133 and 134 (5). If NO in step (5), the controller unit 6 causes the display 138 to display alarm indication of "unrealizable" as a message shown in FIG. 8E (6). The controller unit 6 then causes the display 138 to display alarm indication of copy inhibition as a message shown in FIG. 8F, executes copy inhibition processing (7), and ends the processing.

If YES in step (5), the controller unit 6 causes the display 138 to display a message shown in FIG. 8B to select the other mode by the up and down keys 133 and 134. The controller unit 6 calls the selected copy mode (9) and checks in accordance with a depression state of the asterisk key whether the called mode is OK (10). If NO in step (10), the flow returns to step (8). If YES in step (10), the controller unit 6 checks whether the selected mode is realizable (11). If NO in step (11), the flow returns to step (4). If YES in step (11), the controller unit 6 ends the processing.

In each of the above first to third copy mode calling processing sequences, processing is executed on the basis of a key operation performed when the IC card 8 is already inserted in the apparatus. The copy mode calling processing, however, can be executed on the basis of detection of insertion of the IC card 8.

Figure 7A:
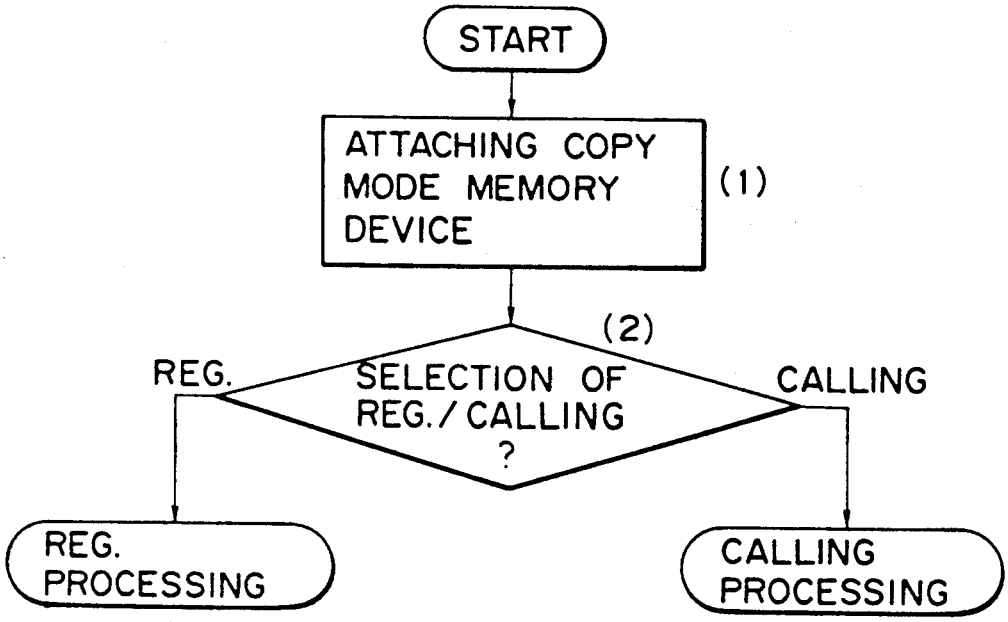
FIG. 7A is a flow chart for explaining a second copy mode selecting processing sequence according to the present invention.

FIG. 7A is a flow chart showing a fourth copy mode processing selecting processing sequence. Note that reference numerals (1) and (2) denote steps.

When the controller unit 6 recognizes via the IC card device 7 that the IC card 8 as a copy mode memory device is inserted in the insertion port 1 (1), it causes the display 138 to display a message shown in FIG. 8A and checks whether registration of a copy mode is selected by the up and down keys 133 and 134 (2). If YES in step (2), the controller unit 6 starts registration processing. If NO in step (2), the controller unit 6 executes calling processing.

Figure 7B:
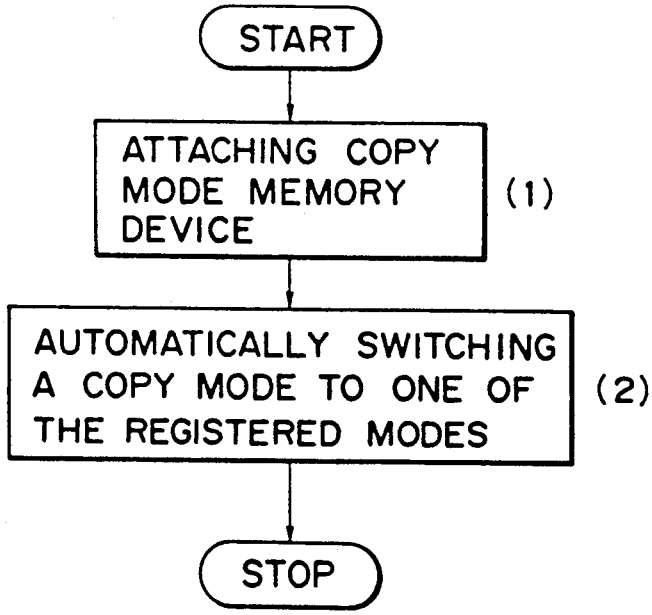
FIG. 7B is a flow chart for explaining a third copy mode selecting processing sequence according to the present invention.

FIG. 7B is a flow chart showing a third copy mode processing selecting processing sequence according to the present invention. Note that reference numerals (1) and (2) denote steps.

When the controller unit 6 recognizes via the IC card device 7 that the IC card 8 is inserted in the insertion port 1 (1), it automatically switches a copy mode to one of the registered modes (2) and ends the processing.

In this manner, one of copy modes (which may be given with a priority order) stored in the IC card 8 can be instantaneously set without a user operation.

As has been described above, the image forming apparatus of the present invention comprises an external mode memory means which can store a copy mode to be set between arbitrary types of machines on the basis of a common data format so that the mode can be read out/written in and which can be inserted in/removed from an arbitrary type of machine, a detecting means for detecting insertion of the external mode memory means, a determining means for determining realizability of the copy mode stored in the external mode memory means on the basis of an output from the detecting means, an alarming means for alarming the determination result from the determining means to a display, and a selective setting means for selecting and automatically setting one of the copy modes stored in the external mode memory means on the basis of the determination result from the determining means. Therefore, a copy mode which is complicated and has a high use frequency can be set for arbitrary types of machines by one external mode memory means. Therefore, a desired copy mode can be set without using an operation panel in a plurality of different types of apparatuses. In addition, since unrealizability is alarmed if a copy mode is unrealizable, no error copy is produced. Furthermore, a load on an operator who is unskilled in copy modes can be largely reduced to increase use efficiency of the image forming apparatus.

In the image forming apparatus of the present invention, the selective setting means selectively sets, as a first candidate, one copy mode which is the last to undergo access from the external mode memory means capable of storing a plurality of copy modes on the basis of the determination result from the determining means. Therefore, a copy mode having a high use frequency can be set by only a few operation tasks in a plurality of types of machines.

In addition, a write/read mode selection state with respect to the external mode memory means is set as an operation mode immediately after the detecting means detects insertion of the external mode memory means. Therefore, since an operator can be clearly informed of registration/calling of a copy mode, copy errors caused by an erroneous operation can be reduced.

Furthermore, a read mode of the external mode memory means is set as an operation mode prior to other modes immediately after the detecting means detects insertion of the external mode memory means. Therefore, since a desired copy mode is set prior to other modes simultaneously with insertion of the external mode memory means without considering copy mode setting, an operation can smoothly advance to image formation processing.

The image forming apparatus is not limited to a copying machine but may be applied to a facsimile apparatus, a printer, and the like.

In addition, a recording system is not limited to an electrophotographic system but may be an ink-jet system, a thermal transfer system, and the like.

What is claimed is:

1. An image forming apparatus from which an external memory medium storing an image formation mode operable in various kinds of image forming apparatus and being adapted for use in said various kinds of image forming apparatus on a common basis is arbitrarily detachable, comprising:

image forming means for forming an image on a recording material in a desired image formation mode;

an attachment unit adapted to attach said external memory medium thereto;

discrimination means for discriminating as to whether an image formation mode stored in said external memory medium is executable or not when said external memory medium is attached to the image forming apparatus; and informing means for informing a discrimination result from said discrimination means.

2. An image forming apparatus according to claim 1, wherein said external memory medium is adapted to store a plurality of image formation modes.

3. An image forming apparatus according to claim 2, further comprising selection means for selecting a desired image formation mode from among the plurality of image formation modes stored in said external memory medium.

4. An image forming apparatus according to claim 3, wherein said discrimination means discriminates as to whether or not the selected image formation mode is executable in accordance with the image formation mode selected by said selection means and any functions of the image forming apparatus to which said external memory medium is attached.

5. An image forming apparatus according to claim 1, wherein said informing means provides a message display as to whether or not the selected image formation mode is executable in accordance with the discrimination result.

6. An image forming apparatus according to any one of claims 1 to 5, wherein said external memory medium is an IC card.

7. An image forming apparatus from which an external memory medium storing a plurality of image formation modes is arbitrarily detachable, comprising:

image forming means for forming an image on a recording material in a desired image formation mode;

an attachment unit adapted to attach said external memory medium thereto;

detecting means for detecting that said external memory medium is attached to said attachment unit; and control means for providing such a control that a predetermined image formation mode is selected and set based on a history of an image formation mode accessed between said external memory medium and said image forming apparatus according to a detection output from said detecting means.

8. An image forming apparatus according to claim 7, further comprising selecting means for selecting a desired image formation mode from among the plurality of image formation modes stored in said external memory medium.

9. An image forming apparatus according to claim 7 or 8, wherein said external memory medium is an IC card.

10. An image forming apparatus from which an external memory medium storing an image formation mode is arbitrarily detachable, comprising:

image forming means for forming an image on a recording material in a desired image formation mode;

input means for inputting a desired image formation mode;

an inserting unit for inserting said external memory medium;

detecting means for detecting insertion of said external memory medium in said inserting unit; and selecting means for selecting one of a registration mode for causing said external memory medium to record an image formation mode input by said input means and a read mode for reading out an image formation mode recorded in said external memory medium, wherein said selecting means selects the read mode prior to the registration mode in response to detection of insertion of said external memory medium by said detecting means.

11. An image forming apparatus according to claim 10, wherein said external memory medium is adapted to store a plurality of image formation modes.

12. An image forming apparatus according to claim 10 or 11, wherein said external memory medium is an IC card.

13. An image forming apparatus according to claim 7, wherein said history is a history of registration of the image formation mode.

14. An image forming apparatus according to claim 13, wherein said predetermined image formation mode is a finally registered image formation mode.

15. An image forming apparatus according to claim 7, wherein said history is a history of readout of the image formation mode.

16. An image forming apparatus according to claim 15, wherein said predetermined image formation mode is a finally read out image formation mode.

* * * * *